US010448177B2

(12) United States Patent
Nielsen et al.

(10) Patent No.: US 10,448,177 B2
(45) Date of Patent: Oct. 15, 2019

(54) METHODS AND DEVICES FOR CORRECT AND SAFE PLACEMENT OF AN IN-EAR COMMUNICATION DEVICE IN THE EAR CANAL OF A USER

(71) Applicant: Oticon A/S, Smørum (DK)

(72) Inventors: Claus Nielsen, Smørum (DK); Søren Laugesen, Smørum (DK)

(73) Assignee: Oticon A/S, Smørum (DK)

( * ) Notice: Subject to any disclaimer, the term of this patent is extended or adjusted under 35 U.S.C. 154(b) by 323 days.

(21) Appl. No.: 15/200,468

(22) Filed: Jul. 1, 2016

(65) Prior Publication Data

US 2017/0006393 A1 Jan. 5, 2017

(30) Foreign Application Priority Data

Jul. 2, 2015 (EP) ..... 15175042

(51) Int. Cl.
*H04R 25/00* (2006.01)

(52) U.S. Cl.
CPC ..... *H04R 25/70* (2013.01); *H04R 25/305* (2013.01); *H04R 25/604* (2013.01); *H04R 25/552* (2013.01); *H04R 2225/023* (2013.01); *H04R 2460/05* (2013.01); *H04R 2460/13* (2013.01); *H04R 2460/15* (2013.01); *H04R 2460/17* (2013.01)

(58) Field of Classification Search
CPC .... H04R 25/70; H04R 25/305; H04R 25/604; H04R 25/552; H04R 2225/023; H04R 2460/05; H04R 2460/13; H04R 2460/15; H04R 2460/17
USPC ..... 381/329, 315, 328, 320, 321
See application file for complete search history.

(56) References Cited

U.S. PATENT DOCUMENTS

| | | | | |
|---|---|---|---|---|
| 7,421,086 | B2 * | 9/2008 | Bauman | H04R 25/608 381/328 |
| 2010/0002897 | A1 | 1/2010 | Keady | |
| 2012/0308062 | A1 * | 12/2012 | Djalilian | H04R 25/606 381/318 |
| 2013/0170660 | A1 * | 7/2013 | Kristensen | H04R 25/305 381/60 |

(Continued)

FOREIGN PATENT DOCUMENTS

| | | | |
|---|---|---|---|
| EP | 2 884 772 | A1 | 6/2015 |
| WO | WO 2012/149955 | A1 | 11/2012 |

*Primary Examiner* — Phylesha Dabney
(74) *Attorney, Agent, or Firm* — Birch, Stewart, Kolasch & Birch, LLP

(57) ABSTRACT

A method for correct placement of an in-ear communication device, e.g. a hearing aid, in an ear canal of a user, the in-ear communication device comprising an acoustic seal towards inner surfaces of the ear canal and being configured to be located in a bony part of the ear canal during normal operation, comprises: placing the in-ear communication device in the ear canal thereby forming a substantial acoustic seal in the soft part of the ear canal; generating body-conducted sound to inner surface portions of the user's ear canal; gradually inserting the device deeper into the ear canal in the direction towards the ear drum, until a position where the sound level perceived by the user decreases; maintaining the device in this position in the ear canal, this position being the correct position of the device in the bony part of the ear canal. An in-ear device is furthermore provided.

13 Claims, 3 Drawing Sheets

(56) References Cited

U.S. PATENT DOCUMENTS

| | | | | |
|---|---|---|---|---|
| 2014/0104053 | A1* | 4/2014 | Clark, Jr. ..... | B60R 16/02<br>340/457.1 |
| 2015/0172829 | A1 | 6/2015 | Droste et al. | |

* cited by examiner

METHODS AND DEVICES FOR CORRECT AND SAFE PLACEMENT OF AN IN-EAR COMMUNICATION DEVICE IN THE EAR CANAL OF A USER

TECHNICAL FIELD

The present disclosure relates to methods used for obtaining a correct placement of in-ear devices in the ear canal of a user. More specifically it relates to such methods for reducing occlusion effect caused by the insertion of an in-ear device in the ear canal and for eliminating the risk of causing damage to the ear canal and/or ear drum by inserting such devices too deeply into the ear canal. The present disclosure further relates to devices for use in such methods. Specifically, the present disclosure relates to in-ear hearing aids and methods for correct and safe insertion of these into the ear canal of a user.

BACKGROUND

In-ear communication devices can be difficult for the user to place correctly in the ear. In particular, hearing aids that are meant to be placed in the bony portion of the ear canal are a challenge. A too shallow placement will jeopardize the audiological benefit of the instrument by producing own-voice occlusion problems, whereas a too deep placement can be uncomfortable and even harmful to the ear canal and the tympanic membrane. As a consequence, for instance prior art in-ear communication devices, such as hearing aids can only be correctly placed in the ear canal of a user by a professional, although the user can remove such prior art devices from the ear canal.

Therefore, there is a need to provide a solution that allows a user not only to remove a deeply seated in-ear communication device, such as a hearing aid, from the ear canal but also to insert the device at its correct position in the ear canal without running a risk of causing damage to the ear canal and/or ear drum.

SUMMARY OF THE DISCLOSURE

The above and further objects and advantages are obtained according to the present disclosure by exploiting the occlusion effect combined with the user's own voice, or alternative sound generators, to guide correct placement of the device in a user's ear canal.

When speaking, the sound of the voice propagates both by air and through the body. Regarding the body-conducted sound of own voice that reaches the ear canal, the propagation is largest via the soft cartilaginous part. When the ear canal is occluded by an in-ear device, the body-conducted part of own voice will be trapped in the ear canal and the level of own-voice sound will increase by several 10s of dB. If the in-ear device is placed in the bony part of the ear canal the dominant soft-part component of body-conducted own voice will be eliminated, which will result in a reduced own-voice sound level. Typically, the perceived sound quality of own voice will also improve as it will be less dominated by low frequency components and hence have a more natural and less "boomy" timbre The occlusion effect can, however, also be generated by other means. In clinical settings a bone conductor can be used to generate body-conducted sound; but e.g. smart phones also have vibrators built in which could be used to generate body-conducted sound, e.g. by pressing the smart phone against the user's mastoid.

According to the present disclosure, this mechanism is used to guide the placement of an in-ear communication device into the bony part of the ear.

Besides being used for obtaining a bony-seal placement of an in-ear device, the methodology can also be used to detect whether or not an in-ear device is sealing or not in the soft part of the ear canal. If there is seal, the occlusion effect will be large, if there is a leakage there will be less occlusion effect.

In the present disclosure, the term "vocalization sound generator" is defined as a generator that is able to provide sound energy at least in the form of body-conducted sound originating from the vocalization sound generator and reaching the inner surface of the ear canal via tissue or bony structures in the body of the user. The vocalization sound generator may additionally be able to provide air-borne sound that reaches the entrance of the user's ear canal. Consequently, a "vocalization sound" as used in the present disclosure is a sound that is at least received at the inner surface of the ear canal via body-conducted transmission from the generator to the ear canal.

With this definition of a "vocalization sound generator" and a "vocalization sound", the user's own voice becomes an example of a vocalization sound and the corresponding generator is the voice organ of the user. However, the concepts of vocalization sound and vocalization sound generator also covers other types of generators, such as a bone conductor, as for instance used in audiometry, or a vibrator as for instance provided in a smartphone.

According to a first aspect of the present disclosure there is provided a method for obtaining a correct placement of an in-ear communication device, such as a hearing aid, in an ear canal of a user, the ear canal having a soft part and a bony part, the in-ear communication device comprising an acoustic seal towards inner surfaces of the ear canal and being configured to be located in the bony part of the ear canal during normal operation, the method comprising the steps of:

- placing the in-ear communication device in the ear canal thereby forming a substantial acoustic seal in the soft part of the ear canal;
- generating body-conducted sound to inner surface portions of the user's ear canal;
- gradually inserting the device deeper into the ear canal in the direction towards the ear drum, until a position in which the sound level perceived by the user decreases;
- maintaining the device in this position in the ear canal, this position being the correct position of the device in the bony part of the ear canal.

In an embodiment of the first aspect, the method comprises the steps of:

- providing an in-ear communication device comprising a probe sound generator configured to emit a probe sound from the device into the ear canal, where the level of the probe sound can be adjusted by the user;
- providing a vocalization sound generator that is able both to generate body-conducted sound from the generator to inner surface portions of the user's ear canal and air-conducted sound that is transmitted via air to the entrance of the user's ear canal; and
- in a first stage:
  - placing the in-ear communication device in the ear canal thereby forming a substantial acoustic seal in the soft part of the ear canal;
  - by means of said vocalization sound generator generate a vocalization sound;

emitting a probe sound from the device into the cavity of the ear canal formed between the device and the ear drum, the probe sound having a level that makes it audible in the presence of the vocalization sound;

the user adjusting the level of the probe sound such that it is just below the masking threshold of the vocalization sound;

in a second stage:

reducing the level of the probe sound below the masking threshold determined in the first stage;

by means of said vocalization sound generator generate substantially the same vocalization sound as in the first stage;

gradually inserting the device deeper into the ear canal in the direction towards the ear drum, until a position in which the probe tone is no longer masked by the vocalization sound, i.e. where the probe sound becomes audible in the presence of the vocalization sound;

maintaining the device in this position in the ear canal, this position being the correct position of the device in the ear canal.

In an embodiment of the first aspect, the method comprises reduction of the level of the probe sound below the masking threshold is in the range 2 dB to 5 dB.

In an embodiment of the first aspect, the level of the vocalization sound is monitored and the level of the probe sound is adjusted in concert with the level of the vocalization sound.

In an embodiment of the first aspect, the spectral content of the monitored vocalization sound is determined and the spectral content of the probe sound is dynamically changed in concert with the spectral content of the vocalization tone.

In an embodiment of the first aspect, both the level and the spectral content of the monitored vocalization sound is determined and the level and spectral content of the probe sound is changed in concert herewith.

In an embodiment of the first aspect, the vocalization sound is generated by the user.

In an embodiment of the first aspect, the probe sound is a band-limited noise.

In an embodiment of the first aspect, the method comprises generating a vocalization sound during gradual insertion of the in-ear communication device into the ear canal of the user; and the user during this gradual insertion ongoing determines the lateral location of the perceived sound image of the vocalization sound within the user's head; and where the in-ear communication device has reached the correct position in the ear canal of the user, when the user perceives a substantial change in loudness balance between the sound images at each respective ear of the user. The vocalization sound can for instance be generated by the user himself.

In an embodiment of the first aspect, the vocalization sound is generated by an external device that is brought in contact with a surface portion of the user's body.

In an embodiment of the first aspect, the external device is a bone-conductor or a vibrator provided in an electronic communication device.

According to a second aspect of the present disclosure there is provide an in-ear communication device comprising:

a housing configured for deep insertion into the ear canal of a user, the housing comprising:

a microphone with a sound inlet at the inlet portion of the in-ear communication device (e.g. a hearing aid), the microphone providing an output signal;

a loudspeaker or receiver provided at the tip portion of the in-ear communication device (e.g. a hearing aid) and configured for emitting sound energy into the ear canal;

a pre-amplifier configured for receiving the output signal from the microphone and providing the amplified signal to an A/D converter, thereby providing a digital representation of the amplified microphone signal;

a band pass filter configured for receiving the digital signal from the A/D converter and providing a band pass filtered output signal;

a level detector configured for receiving the band pass filtered output signal from the band pass filter and for determining the level of the band pass filtered output signal from the band pass filter;

a probe sound generating means;

a gain adjusting means;

a gain determining means configured to determine a gain factor of the probe sound signal provided by the probe sound generating means, which gain factor is provided to the gain adjusting means thereby providing a gain-adjusted probe sound signal;

a D/A converter and an output amplifier configured to receive the gain adjusted probe sound signal and providing it to the loudspeaker or receiver (22) for emission into the ear canal.

In an embodiment of the second aspect, the gain determining means is a gain table.

In an embodiment of the first aspect, the transfer function of the combination of said level detector and gain determining means is given by the expression:

$$\frac{\text{probe sound gain}}{\text{level detector output}} = \begin{cases} c1 \text{ for } L1 < L \\ aL \text{ for } L1 < L < L2 \\ c2 \text{ for } L > L2 \end{cases}$$

where c1, c2 and a are constants and where c1<c2.

In an embodiment of the second aspect, the device is a hearing aid.

In an embodiment of the first aspect, the device is the loudspeaker or receiver portion of a head-set.

Definitions

In the present context, a 'hearing aid' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing aid' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing aid may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing aid may comprise a single unit or several units communicating electronically with each other.

More generally, a hearing aid comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing aids, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing aid and/or for storing information (e.g. processed information, e.g. provided by the signal processing circuit), e.g. for, use in connection with an interface to a user and/or an interface to a programming device. In some hearing aids, the output means may comprise an output transducer, such as e.g. a loudspeaker for providing an air-borne acoustic signal or a vibrator for providing a structure-borne or liquid-borne acoustic signal. In some hearing aids, the output means may comprise one or more output electrodes for providing electric signals.

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal to the cochlear liquid, e.g. through the oval window. In some hearing aids, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing aids, and a 'binaural hearing system' refers to a system comprising two hearing aids and being adapted to cooperatively provide audible signals to both of the user's ears. Hearing systems or binaural hearing systems may further comprise one or more 'auxiliary devices', which communicate with the hearing aid(s) and affect and/or benefit from the function of the hearing aid(s). Auxiliary devices may be e.g. remote controls, audio gateway devices, mobile phones (e.g. SmartPhones), public-address systems, car audio systems or music players. Hearing aids, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION OF AN EXAMPLE EMBODIMENT OF THE DISCLOSURE

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details.

Figures 1A, 1B:
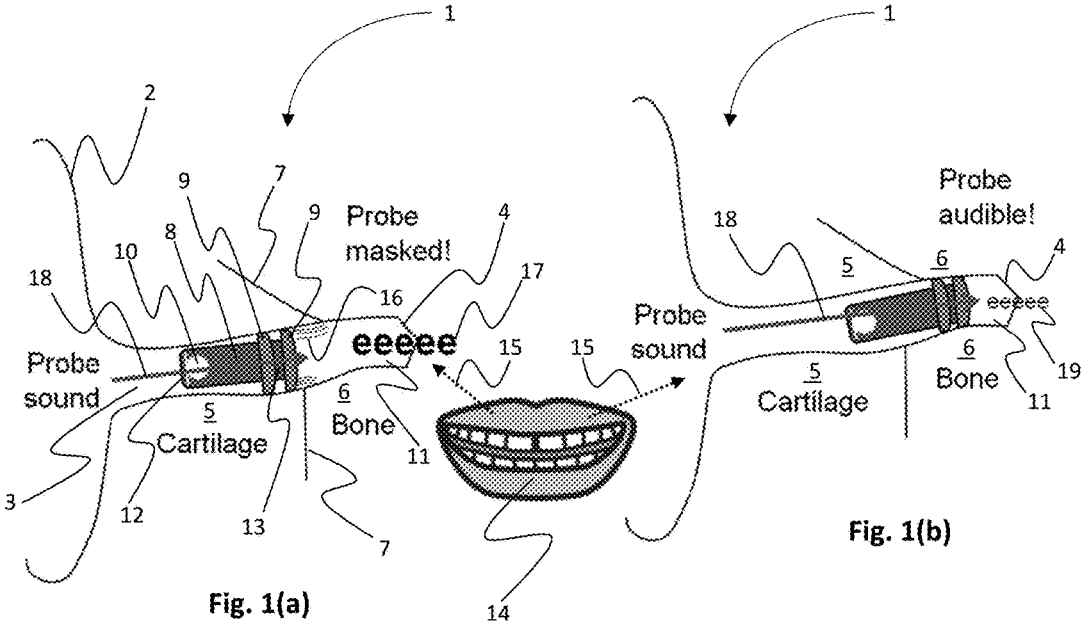
FIG. 1(*a*) and FIG. 1(*b*) illustrate schematically an embodiment of the method according to the present disclosure.

Referring to FIGS. 1(*a*) and (*b*) there is shown an example of the application of the method according to the first aspect of the present disclosure illustrating the placement of an instant-fit hearing-aid 8 designed to sit in the bony part 6 of the ear canal 3.

Referring to FIG. 1(*a*), the ear canal comprises an outer cartilaginous part 5 closest to the entry of the ear canal facing the pinna 2, and an inner bony part 6 that terminates at the ear drum 4. The interface between these two parts is indicated by reference numeral 7. In the situation shown in FIG. 1(*a*), the hearing aid 8 is inserted in the ear canal 3 (as indicated by the arrow 18) to a position in the soft cartilaginous part 5 of the ear canal 3 where there is established a seal between the inner surface of the ear canal and sealing elements or domes 9 provided in the tip region 13 of the hearing aid 8. The hearing aid is provided with a probe sound generator and a receiver that emits the probe sound into the ear canal, i.e. into the cavity 11 formed in the ear canal between the tip portion 13 of the hearing aid and the ear drum 4. The hearing aid is further provided with a microphone 10 with a sound inlet at the inlet portion 12 of the hearing aid.

In this example the user acts as the vocalization sound generator and produces a suitable vocalization sound 7, e.g. the sound "eeeeeee". It is of cause possible to use many other vocalization sounds instead. This vocalization sound is transmitted from the mouths of the user as air borne sound (see reference numeral 20 in FIG. 2) and as body-conducted vibrations (see reference numeral 21 in FIG. 2) from the vocal organs through tissue and bony structures to the inner surface of the ear canal. These vibrations set the soft surface portion of the ear canal in motion as indicated schematically by reference numeral 16 in FIG. 1(*a*).

When the hearing aid is situated with a seal in the outer cartilaginous part 5 of the ear canal the occlusion effect is large, i.e. the sound radiation into the ear canal from the soft surface portion of the ear canal at 16 in FIG. 1(*a*) is large and the level of the vocalization sound "eeeee" is large in the residual cavity between the hearing aid 8 and the tympanic membrane 4.

Many different kinds of probe sound could be used in the methods and devices according to the present disclosure. It has for instance been found that a useful probe sound is a 2-octave wide band of random noise centered at 300 Hz and modulated by a 4-Hz sinusoidal envelope.

Figure 2:
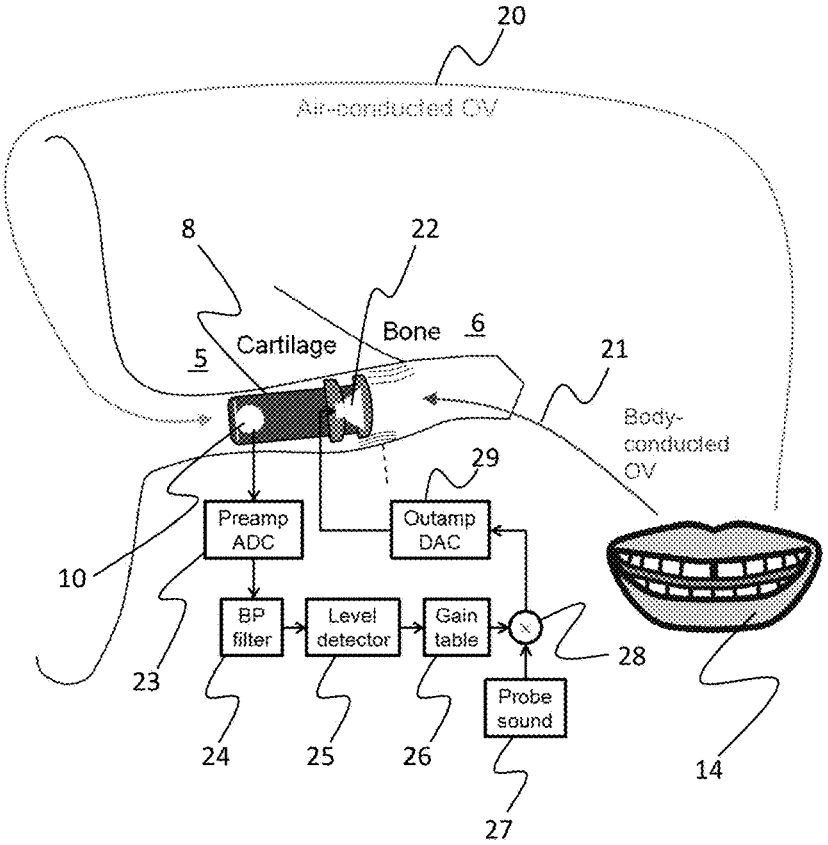
FIG. 2 shows a schematic representation of an embodiment of an in-ear communication device according to the present disclosure configured to be inserted into the ear canal of a user by application of an embodiment of a method according to the present disclosure.

Referring to FIG. 2 there is schematically shown an embodiment of a device according to the present disclosure. In this embodiment, the level of the probe sound is adjusted dynamically in concert with the vocalization sound level, using a probe sound gain characteristic as illustrated in FIG. 3.

Figure 3:
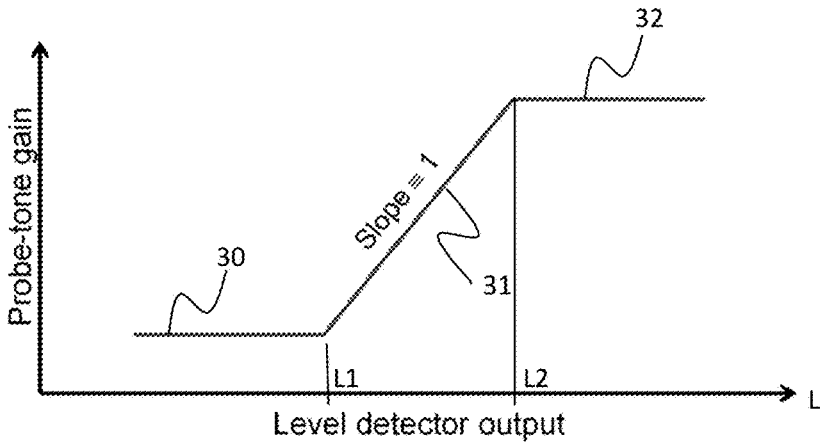
FIG. 3 shows a plot of probe sound gain as a function level detector output relating to the embodiment of an in-ear communication device shown in FIG. 2.

The characteristic shown in FIG. 3 ensures that the probe sound remains audible even when the user stops vocalizing, and also puts a limit to the possible output, to avoid distortion and an uncomfortably loud probe sound. Between these limits the balance between vocalization level and probe sound is constant. The characteristic shown in FIG. 3 is given by the expression:

$$\frac{\text{probe sound gain}}{\text{level detector output}} = \begin{cases} c1 \text{ for } L1 < L \\ aL \text{ for } L1 < L < L2 \\ c2 \text{ for } L > L2 \end{cases}$$

where c1, c2 and a are constants and where c1<c2. The constant a would typically be set to 1.

The air-conducted vocalization sound 20 is picked up by the microphone 10 in the hearing aid 8, and the output signal from the microphone 10 is amplified and converted to a digital signal in the preamplifier and A/D converter circuit 23. The digital signal is passed through a band pass filter 24, the output signal of which is provided to a level detector 25. The detected level of the air conducted vocalization sound is translated to the probe sound gain by means of a gain table 26 using a probe sound gain versus level detector output characteristic as shown in FIG. 3. It is understood that the shown characteristic only constitutes an example, at that other characteristics might be used. The characteristic shown in FIG. 3 limits the total variation of the probe sound gain between a predetermined lower level 30 and a predetermined upper level 32. Between these levels, the probe tone gain increases linearly with the level detector output signal as indicated by the line 31, which has a slope of 1. It is understood that other slopes might be used. The hearing aid 8 is further provided with a probe sound generator 27 and the output signal from this is subjected to the appropriate gain as determined as described above in the multiplicator 28. The output signal from the multiplicator 28 is provided to a D/A converter and output amplifier 29, the output signal of which is provided to the hearing aid receiver 22, from which it emitted as a probe sound into the ear canal cavity between the tip of the hearing aid and the eardrum.

It is understood that although the system shown in FIG. 2 has been described as a digital system, it would also be possible to implement the probe sound adjusting function as an analog system without hereby departing from the scope of the present disclosure.

The first part of the procedure outlined above could be done together with the hearing-care professional during the audiological fitting of the hearing aid. The second part of the procedure could either be used together with the audiological fitting to obtain the correct position of the hearing aid as part of the fitting, or/and it could be used on a day-to-day basis by the user to obtain correct placement of the hearing aid at every insertion at home. Possibly, the balance threshold from the first stage would then have to be updated e.g. once a month. This could be done at home or together with a hearing-care professional.

Figure 4:
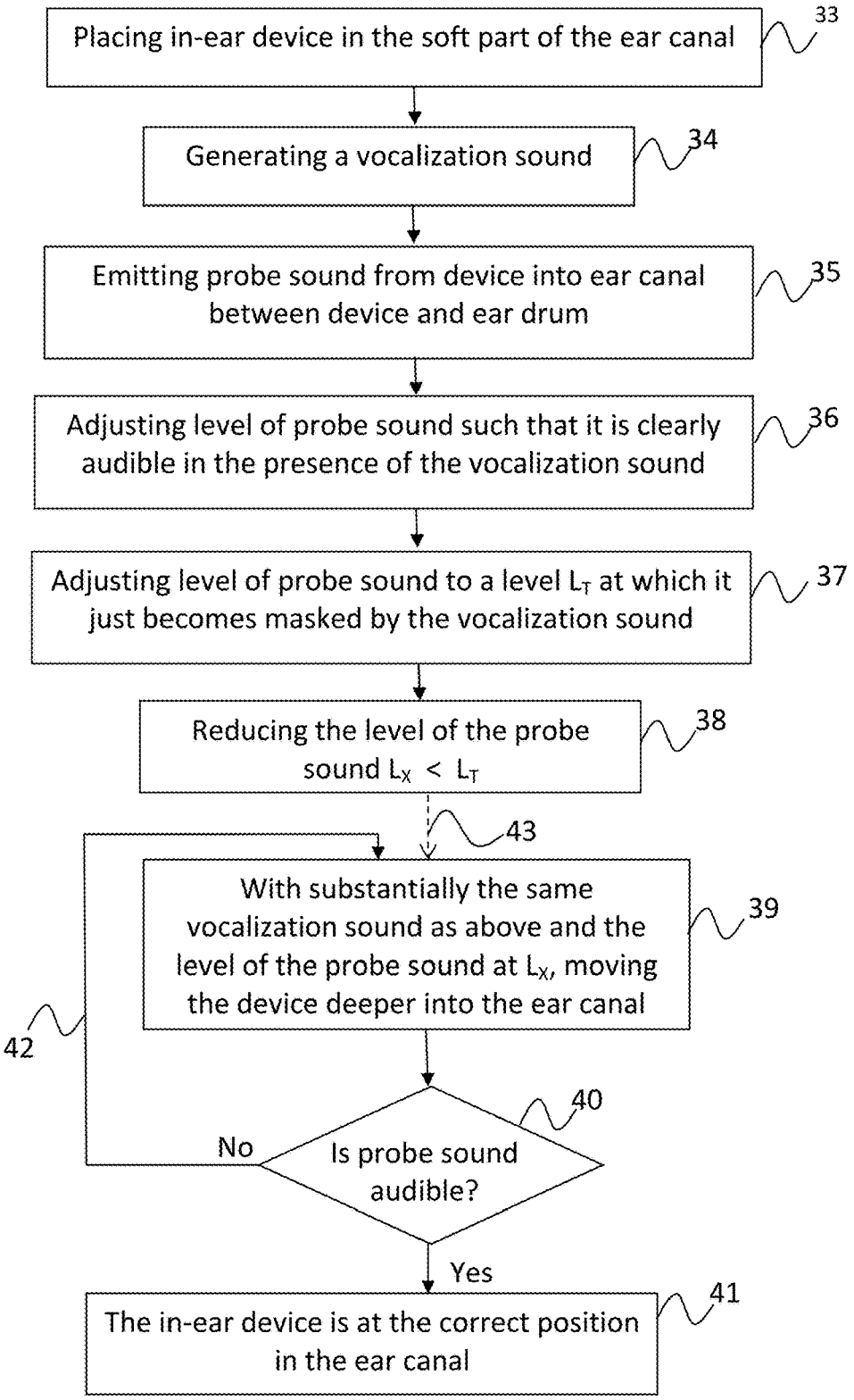
FIG. 4 illustrates an embodiment of a method according to the present disclosure by means of a flow chart.

An embodiment of the method according the present disclosure is illustrated by means of the flow chart presented in FIG. 4.

In step 33 the in-ear device is placed in the soft part of the user's ear canal. In step 34 a vocalization sound is generated, for instance by the user himself. In step 35 a probe sound is emitted from the in-ear device and into the cavity formed in the ear canal between the in-ear device and the user's ear drum. In step 36 the level of the probe sound is adjusted such that the probe sound is clearly audible above the vocalization sound. In step 37 the masking level $L_T$ of the probe sound in the presence of the vocalization sound is determined. In step 38 the level of the probe sound is reduced below the masking level, i.e. to a level where the probe sound in no longer audible. It has been found in practice that a level reduction of approximately 3 dB is suitable, although other level reductions might also be chosen, for instance depending on the nature of the vocalization sound and the probe sound. In step 39 the in-ear device in inserted deeper into the ear canal, i.e. moved in the direction towards the ear drum and in step 40 it is determined if the probe sound has again become audible. If this is the case, the correct position of the in-ear device has been found as indicated at 41 in FIG. 4. If the probe tone has not yet become audible the in-ear device is moved slightly further towards the ear drum as indicated by 42.

The broken line arrow 43 indicates that the steps preceding step 39 could be carried out at a different time or place than the steps 39 to 42, as described above.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A method for obtaining a correct placement of an in-ear communication device in an ear canal of a user, the ear canal having a soft part and a bony part, the in-ear communication device comprising an acoustic seal towards inner surfaces of the ear canal and being configured to be located in the bony part of the ear canal during normal operation, the method comprising the steps of:

providing an in-ear communication device comprising a probe sound generator configured to emit a probe sound from the device into the ear canal, where the level of the probe sound can be adjusted by the user; and in a first stage:

placing the in-ear communication device in the ear canal thereby forming a substantial acoustic seal in the soft part of the ear canal;

generating a vocalization sound that provides both body-conducted sound to inner surface portions of the user's ear canal and air-conducted sound transmitted via air to the entrance of the user's ear canal;

emitting a probe sound from the device into the cavity of the ear canal formed between the device and the ear drum, the probe sound having a level that makes it audible in the presence of the vocalization sound;

the user adjusting the level of the probe sound such that it is just below the masking threshold of the vocalization sound;

in a second stage:

reducing the level of the probe sound below the masking threshold determined in the first stage;

generating substantially the same vocalization sound as in the first stage;

gradually inserting the device deeper into the ear canal in the direction towards the ear drum, until a position in which the probe tone is no longer masked by the vocalization sound, i.e. where the probe sound becomes audible in the presence of the vocalization sound;

maintaining the device in this position in the ear canal, this position being the correct position of the device in the ear canal.

2. A method according to claim 1, wherein said reduction of the level of the probe sound below the masking threshold is in the range 2 dB to 5 dB.

3. A method according to claim 1, wherein the level of the vocalization sound is monitored and the level of the probe sound is adjusted in concert with the level of the vocalization sound.

4. A method according to claim 1, wherein the spectral content of the monitored vocalization sound is determined and the spectral content of the probe sound is dynamically changed in concert with the spectral content of the vocalization tone.

5. A method according to claim 1, wherein both the level and the spectral content of the monitored vocalization sound is determined and the level and spectral content of the probe sound is changed in concert herewith.

6. A method according to claim 1, wherein the vocalization sound is generated by the user.

7. A method according to claim 1, wherein the probe sound is a band-limited noise.

8. A method according to claim 1, wherein said vocalization sound is generated by an external device that is brought in contact with a surface portion of the user's body.

9. A method according to claim 8, wherein said external device is a bone-conductor or a vibrator provided in an electronic communication device.

10. An in-ear communication device comprising:

a housing configured for deep insertion into the ear canal of a user, the housing comprising:

a microphone with a sound inlet at the inlet portion of the in-ear communication device, the microphone providing an output signal;

a loudspeaker or receiver provided at the tip portion of the in-ear communication device and configured for emitting sound energy into the ear canal;

a level detector configured for receiving the output signal from the microphone and for determining the level of the output signal from the microphone;

a probe sound generating means;

a gain adjusting means;

a gain determining means configured to determine a gain factor of the probe sound signal provided by the probe sound generating means, which gain factor is provided to the gain adjusting means thereby providing a gain-adjusted probe sound signal; and providing said gain-adjusted probe sound signal to the loudspeaker or receiver for emission into the ear canal, wherein said gain determining means is a gain table.

11. An in-ear communication device according to claim 10 where the transfer function of the combination of said level detector and gain determining means is given by the expression:

$$\frac{\text{probe sound gain}}{\text{level detector output}} = \begin{cases} c1 \text{ for } L1 < L \\ aL \text{ for } L1 < L < L2 \\ c2 \text{ for } L > L2 \end{cases}$$

where c1, c2 and a are constants and where c1<c2.

12. An in-ear communication device according to claim 10, where the device is or comprises a hearing aid.

13. An in-ear communication device according to claim 10 where the device is or comprises a loudspeaker or receiver portion of a head-set.

* * * * *